US008091253B2

(12) United States Patent
Clark et al.

(10) Patent No.: US 8,091,253 B2
(45) Date of Patent: Jan. 10, 2012

(54) FABRIC ARTICLE TREATING DEVICE AND SYSTEM

(75) Inventors: Melissa Dee Clark, Cincinnati, OH (US); Christopher Lawrence Smith, Liberty Township, OH (US); Paul Amaat Raymond Gerard France, West Chester, OH (US); Laura Lynn Heilman, Cincinnati, OH (US); Paul Van den Hoonaard, Peachtree, GA (US); Geoffrey Luther Oberhaus, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 605 days.

(21) Appl. No.: 11/171,101

(22) Filed: Jun. 30, 2005

(65) Prior Publication Data

US 2006/0080860 A1 Apr. 20, 2006

Related U.S. Application Data

(63) Continuation-in-part of application No. 10/926,925, filed on Aug. 26, 2004, and a continuation-in-part of application No. 10/927,211, filed on Aug. 26, 2004.

(51) Int. Cl.
*F26B 11/02* (2006.01)

(52) U.S. Cl. ..... 34/597; 34/60; 34/565

(58) Field of Classification Search ..... 34/380, 34/389, 565, 597, 60, 74; 134/93; 222/521, 222/528, 531, 532, 536, 537, 544
See application file for complete search history.

(56) References Cited

U.S. PATENT DOCUMENTS

| | | | |
|---|---|---|---|
| 2,079,280 | A | 5/1937 | Couch |
| 2,807,893 | A | 10/1957 | Morey |
| 2,812,593 | A | 11/1957 | Olthuis |
| 2,846,776 | A | 8/1958 | Clark |
| 2,851,791 | A | 9/1958 | Olthuis |
| 2,873,539 | A | 2/1959 | Morey |
| 2,941,309 | A | 6/1960 | Cobb |

(Continued)

FOREIGN PATENT DOCUMENTS

DE 23 18 596 B2 4/1980

(Continued)

OTHER PUBLICATIONS

International Critical Tables of Numerical Data, Physics, Chemistry and Technology, National Research Council of the United States of America, Edward W. Washburn, editor in chief, first electronic edition, published by Knovel, Norwich, New York, 2003, pp. 148-162.

(Continued)

*Primary Examiner* — Jiping Lu
(74) *Attorney, Agent, or Firm* — Julie A. Mcconihay; Leonard W. Lewis; Steven W. Miller

(57) ABSTRACT

A fabric article treating device having a dispenser adapted for location inside of a fabric article drying appliance and a removable reservoir. The dispenser and reservoir are adapted for fluid communication with one another. The reservoir is configured to contain a benefit composition and to minimize leakage of the benefit composition during installation and removal of the removable reservoir. Corresponding male and female fitments establish fluid communication between the dispenser and the reservoir. The male fitment is adapted to pivot to aid in engaging the female fitment.

26 Claims, 9 Drawing Sheets

U.S. PATENT DOCUMENTS 2,958,954 A 11/1960 Longenecker
3,002,288 A 10/1961 Conlee
3,022,580 A 2/1962 Doty
3,103,450 A 9/1963 Janson
3,114,653 A 12/1963 Kruzan
3,172,604 A 3/1965 Brock
3,180,037 A 4/1965 Kenreich et al.
3,239,947 A 3/1966 Kenreich et al.
3,267,701 A 8/1966 Mandarino
3,364,585 A 1/1968 Fish
3,583,180 A 6/1971 Arbogast
3,595,036 A 7/1971 Laddle
3,634,947 A 1/1972 Furgal
3,816,070 A 6/1974 Candor et al.
3,872,604 A 3/1975 Keller
4,009,598 A 3/1977 Bernard et al.
4,014,105 A 3/1977 Furgal et al.
4,022,938 A 5/1977 Zaki et al.
4,098,937 A 7/1978 Mizuno et al.
4,207,683 A 6/1980 Horton
4,236,320 A 12/1980 Schwadike et al.
4,242,377 A 12/1980 Roberts et al.
4,341,347 A 7/1982 DeVittorio
4,373,647 A * 2/1983 Hollingsworth ..... 222/528
4,501,682 A 2/1985 Goodman et al.
4,511,495 A 4/1985 Melville
4,532,722 A 8/1985 Sax
4,567,675 A 2/1986 Rennie
4,579,279 A 4/1986 Marchant
4,618,099 A 10/1986 Nagao et al.
4,642,908 A 2/1987 Brenner
4,806,254 A 2/1989 Church
4,840,206 A * 6/1989 Hill et al. ..... 141/349
4,891,890 A 1/1990 Church
5,040,311 A 8/1991 Roy
5,219,371 A * 6/1993 Shim et al. ..... 8/149.1
5,234,610 A 8/1993 Gardlik et al.
5,369,892 A * 12/1994 Dhaemers ..... 34/275
5,396,715 A * 3/1995 Smith ..... 34/261
5,438,773 A 8/1995 Chaffee
5,442,938 A 8/1995 Kislyuk
5,445,747 A 8/1995 Kvietok et al.
5,461,742 A 10/1995 Pasad et al.
5,595,071 A 1/1997 Pasad et al.
5,724,256 A * 3/1998 Lee et al. ..... 700/285
5,749,163 A 5/1998 Staub et al.
5,771,604 A 6/1998 Wunderlich et al.
5,789,368 A 8/1998 You et al.
5,810,265 A 9/1998 Cornelius et al.
5,884,418 A 3/1999 Mc Nally
5,912,408 A 6/1999 Trinh et al.
5,930,909 A 8/1999 Mc Nally
5,945,111 A 8/1999 Esser
5,965,517 A 10/1999 Mooney
5,966,831 A 10/1999 Anderson
5,968,404 A 10/1999 Trinh et al.
5,980,583 A 11/1999 Staub et al.
5,997,759 A 12/1999 Trinh et al.
6,001,343 A 12/1999 Trinh et al.
6,067,723 A 5/2000 Lafrenz
6,103,678 A 8/2000 Masschelein et al.
6,160,110 A 12/2000 Thomaides et al.
6,277,810 B2 8/2001 Baines et al.
6,279,834 B1 8/2001 Fox et al.
6,315,800 B1 11/2001 Gomes et al.
6,376,455 B1 4/2002 Friedi et al.
6,474,563 B2 11/2002 Pletcher et al.
6,491,840 B1 12/2002 Frankenbach et al.
6,503,413 B2 1/2003 Uchiyama et al.
6,571,993 B2 6/2003 Rodd et al.
6,574,883 B2 6/2003 Giblin et al.
6,598,808 B1 * 7/2003 Garcia et al. ..... 239/327
6,604,297 B2 8/2003 Hagemann et al.
6,609,311 B2 8/2003 Hagemann et al.
6,696,405 B2 2/2004 Mooney
6,792,695 B2 9/2004 Fry et al.
6,871,679 B2 3/2005 Last
6,883,723 B2 4/2005 Griese et al.
6,889,399 B2 5/2005 Steiner et al.
7,059,065 B2 6/2006 Gerlach et al.
7,146,749 B2 12/2006 Barron et al.
2001/0036909 A1 11/2001 Levinson
2001/0044399 A1 11/2001 Keppie et al.
2001/0052551 A1 12/2001 Pletcher et al.
2001/0052552 A1 12/2001 Hamaguchi et al.
2002/0050073 A1 5/2002 Hagemann et al.
2002/0069465 A1 6/2002 Chute et al.
2002/0078589 A1 6/2002 Hagemann et al.
2002/0083615 A1 7/2002 Giblin et al.
2002/0100122 A1 8/2002 Rodrigues et al.
2002/0112293 A1 8/2002 Trinh et al.
2003/0035748 A1 2/2003 Trinh et al.
2003/0196348 A1 10/2003 Hagemann et al.
2003/0199416 A1 10/2003 Fry et al.
2003/0199417 A1 10/2003 Fry et al.
2003/0200674 A1 10/2003 Fry et al.
2003/0213145 A1 11/2003 Hagemann et al.
2003/0224965 A1 12/2003 Conley et al.
2004/0064970 A1 4/2004 Hagemann et al.
2004/0118014 A1 6/2004 Burgess et al.
2004/0123489 A1 7/2004 Pancheri et al.
2004/0123490 A1 7/2004 Pancheri et al.
2004/0134090 A1 7/2004 Heilman et al.
2004/0134094 A1 7/2004 Hahn et al.
2004/0221476 A1 11/2004 Jones et al.
2004/0253376 A1 12/2004 Parker
2004/0259750 A1 12/2004 DuVal et al.
2005/0020478 A1 1/2005 Cooke et al.
2005/0022311 A1 * 2/2005 Zhang et al. ..... 8/115.51
2005/0076453 A1 4/2005 Lucas et al.
2005/0076532 A1 4/2005 Ward et al.
2005/0076533 A1 4/2005 Huston et al.
2005/0120584 A1 6/2005 Ofosu-Asante et al.
2005/0251924 A1 11/2005 DuVal et al.
2006/0162180 A1 7/2006 Heilman et al.
2006/0191157 A1 8/2006 Gerlach et al.
2007/0000068 A1 1/2007 France et al.
2007/0000291 A1 1/2007 France et al.

FOREIGN PATENT DOCUMENTS

EP 0 130 682 1/1985
EP 0 118 313 5/1987
EP 0 315 879 B1 5/1989
EP 0 204 484 B1 3/1992
EP 0 594 154 A1 4/1994
EP 0 848 999 A2 6/1998
EP 0 676 497 B1 9/1999
EP 0 953 669 A2 11/1999
EP 1 479 757 A1 11/2004
GB 2 066 309 A 7/1981
GB 2 231 944 A 11/1990
GB 2 354 006 B 3/2001
GB 2 366 568 A 3/2002
GB 2 346 678 B 10/2002
JP 02-302300 12/1990
JP 06-015090 1/1994
JP 1995068094 A2 3/1995
JP 08-150293 6/1996
JP 1996215488 A 8/1996
JP 09-267000 A 10/1997
JP 10-290898 A 11/1998
JP 2002069832 A2 3/2002
JP 2002115182 A 4/2002
WO WO 96/09430 3/1996
WO WO 99/55952 A1 11/1999
WO WO 99/55953 A1 11/1999
WO WO 00/01421 A1 1/2000
WO WO 00/01422 A1 1/2000
WO WO 00/01493 A1 1/2000
WO WO 00/11133 3/2000
WO WO 00/24851 A2 5/2000
WO WO 00/24856 A1 5/2000
WO WO 00/24858 A1 5/2000
WO WO 00/38512 A1 7/2000
WO WO 00/55292 9/2000
WO WO 00/58428 10/2000
WO WO 01/07710 A1 2/2001

| | | | |
|---|---|---|---|
| WO | WO 01/18145 | A2 | 3/2001 |
| WO | WO 01/66264 | A1 | 9/2001 |
| WO | WO 02/08510 | A1 | 1/2002 |
| WO | WO 01/12423 | A2 | 2/2002 |
| WO | WO 02/26585 | A1 | 4/2002 |
| WO | WO 02/33161 | A1 | 4/2002 |
| WO | WO 02/40623 | A2 | 5/2002 |
| WO | WO 03/004170 | A1 | 1/2003 |
| WO | WO 03/008528 | A1 | 1/2003 |
| WO | WO 03/066461 | A1 | 8/2003 |
| WO | WO 03/087286 | A1 | 10/2003 |
| WO | WO 03/087461 | A1 | 10/2003 |
| WO | WO 03/102289 | A1 | 12/2003 |
| WO | WO 2004/099489 | A2 | 11/2004 |
| WO | WO 2004/106788 | A1 | 12/2004 |
| WO | WO 2005/066037 | A1 | 7/2005 |
| WO | WO 2005/102067 | A1 | 11/2005 |

OTHER PUBLICATIONS

Handbook of Chemistry and Physics, 3rd electronic edition, following the 81st printed edition, David R. Lide, editor-in-chief, published by CRC Press, Inc. 2000, Boca Raton, Florida, pp. 5-102 to 5-103, 5-4 to 5-88.

Perry's Chemical Engineer's Handbook, seventh edition, following the 81st printed edition, published by McGraw-Hill, ISBN 0-07-049841-5, 1997, pp. 2-187 to 2-195.

Brokaw, Leslie—"Get a Whiff Of This", Inc.com Magazine, Nov. 1988, (1 page) Copyright 2003 Gruner + Jahr USA Publishing, Inc. com, 77 North Washington Street, Boston, MA 02114.

StainsFile—"Classification of Dyes"; "Basic Dyes"; "Direct Dyes"; "Acid Dyes"; Comparison of Dye Structure; "Structure and Colour in Dyes"; (16 pages). Internet Website http://members.pgonline.com/~bryand/StainsFile/dyes/class/dyeclass.htm, Nov. 2002.

Innovative Packaging Network—"Clean-Clic®" (1 page). Internet Website www.ipneurope.com/Componentright1.html.

Medlin, Jennifer—"Microban, Germ Warfare", Environmental Health Perspectives v.105, n.3, Mar. 1997 (5 pages). Internet Website www.mindfully.org/Plastic/Microban-Germ-Warfare.htm.

Exair-Mail Newsletter—Winter 2002-03 (2 pages). Exair Corporation, 1250 Century Circle North, Cincinnati, Ohio, 45246-3309.

Fyffe, Matt—Technical Report—"Recent Developments in Long-Range Static Elimination", Jun. 2003 (3 pages). Meech Static Eliminators, USA, Richfield, Ohio, Internet Website www.meech.com.

Quantum Research Group "Capacitance Explained" printed Nov. 18, 2004 (3 pages). Internet Website www.qprox.com/background/capacitance.php.

U.S. Appl. No. 11/592,359, filed Nov. 3, 2006, Barron et al.

U.S. Appl. No. 10/762,152, filed Jan. 21, 2004, DuVal, et al., WO 04/12007.

* cited by examiner

FABRIC ARTICLE TREATING DEVICE AND SYSTEM

CROSS REFERENCE TO RELATED APPLICATIONS

This application is a continuation-in-part of: U.S. Ser. No. 10/926,925, filed on Aug. 26, 2004 and U.S. Ser. No. 10/927,211, filed on Aug. 26, 2004.

FIELD OF THE INVENTION

The present invention relates to a fabric article treating device for use with a fabric article drying appliance, and more specifically to a unique fabric article treating device and system for dispensing a benefit composition.

BACKGROUND OF THE INVENTION

Fabric article treating methods and/or apparatuses have been evolving over the past twenty years. There exists an ongoing need to develop a fabric article treating method and/or apparatus, especially an in-home fabric article treating method and/or apparatus that improves/enhances the deposition of fabric article actives or benefit agents on the fabric articles being treated as compared to the currently existing deposition methods and/or apparatuses.

One particular challenge presented in the delivery of fabric article actives in the fabric article drying environment is to create a system wherein the user can easily switch between different fabric actives for each particular load of clothing while minimizing any leakage of the benefit composition. For instance, when treating fabric articles for a female, the user may desire a feminine scent; whereas when treating fabric articles for a male, a more masculine scent. As such, it would be advantageous to provide a fabric article treating device comprising a removable reservoir which minimizes any leakage of the benefit composition when switching between reservoirs.

SUMMARY OF THE INVENTION

The present invention is directed to fabric article treating devices and fabric article treating systems. More particularly, the invention is directed to fabric article treating devices in which the housing and/or reservoir are configured to minimize any leakage, for example, due to potential misalignment of the fitments at the time of engagement and disengagement.

One embodiment of the present invention is a fabric article treating device. The fabric article treating device comprises a dispenser, a removable reservoir and a housing adapted to receive the removable reservoir. The dispenser and removable reservoir are adapted for fluid communication with one another. The removable reservoir is configured to contain a benefit composition. The housing comprises one of corresponding male and female fitments and the removable reservoir comprises the other of the corresponding male and female fitments. The female fitment is configured to receive the male fitment to establish fluid communication between the dispenser and the removable reservoir. One of the fitments is adapted to pivot to aid in engaging the corresponding fitment.

Another embodiment of the present invention is a fabric article treating device. The fabric article treating device comprises a dispenser, a removable reservoir and a housing adapted to receive the removable reservoir. The dispenser and removable reservoir are adapted for fluid communication with one another. The removable reservoir is configured to contain a benefit composition. The housing comprises a male fitment and the removable reservoir comprises a corresponding female fitment. The female fitment is configured to receive the male fitment to establish fluid communication between the dispenser and the removable reservoir. The male fitment is adapted to pivot to aid in engaging the female fitment. The male fitment pivots between an installation position and a use position to aid in engaging the female fitment. The housing further comprises a door, wherein the door is adapted to pivot from an open position to a closed position, such that in the closed position the male fitment is engaged with the female fitment. The door is provided with a slot adapted to slidingly receive the female fitment when the female fitment is receiving the male fitment, wherein the slot is adapted to allow the female fitment to slide from a first position to a second position.

Yet another embodiment of the present invention is a fabric article treating system. The fabric article treating system comprises a fabric article drying appliance having a chamber and a closure structure. The closure structure has a closed position and at least one open position and is adapted to allow access to the chamber. The fabric article treating system also includes a dispenser and a removable reservoir. The dispenser and removable reservoir are adapted for fluid communication with one another. The removable reservoir is configured to contain a benefit composition. The fabric article drying appliance is adapted to receive the removable reservoir. The fabric article drying appliance comprises one of corresponding male and female fitments and the removable reservoir comprises the other of the corresponding male and female fitments. The female fitment is configured to receive the male fitment to establish fluid communication between the dispenser and the removable reservoir. One of the fitments is adapted to pivot to aid in engaging the corresponding fitment.

BRIEF DESCRIPTION OF THE DRAWINGS

While the specification concludes with claims particularly pointing out and distinctly claiming the invention, it is believed the same will be better understood from the following description taken in conjunction with the accompanying drawings in which:

Figure 1:
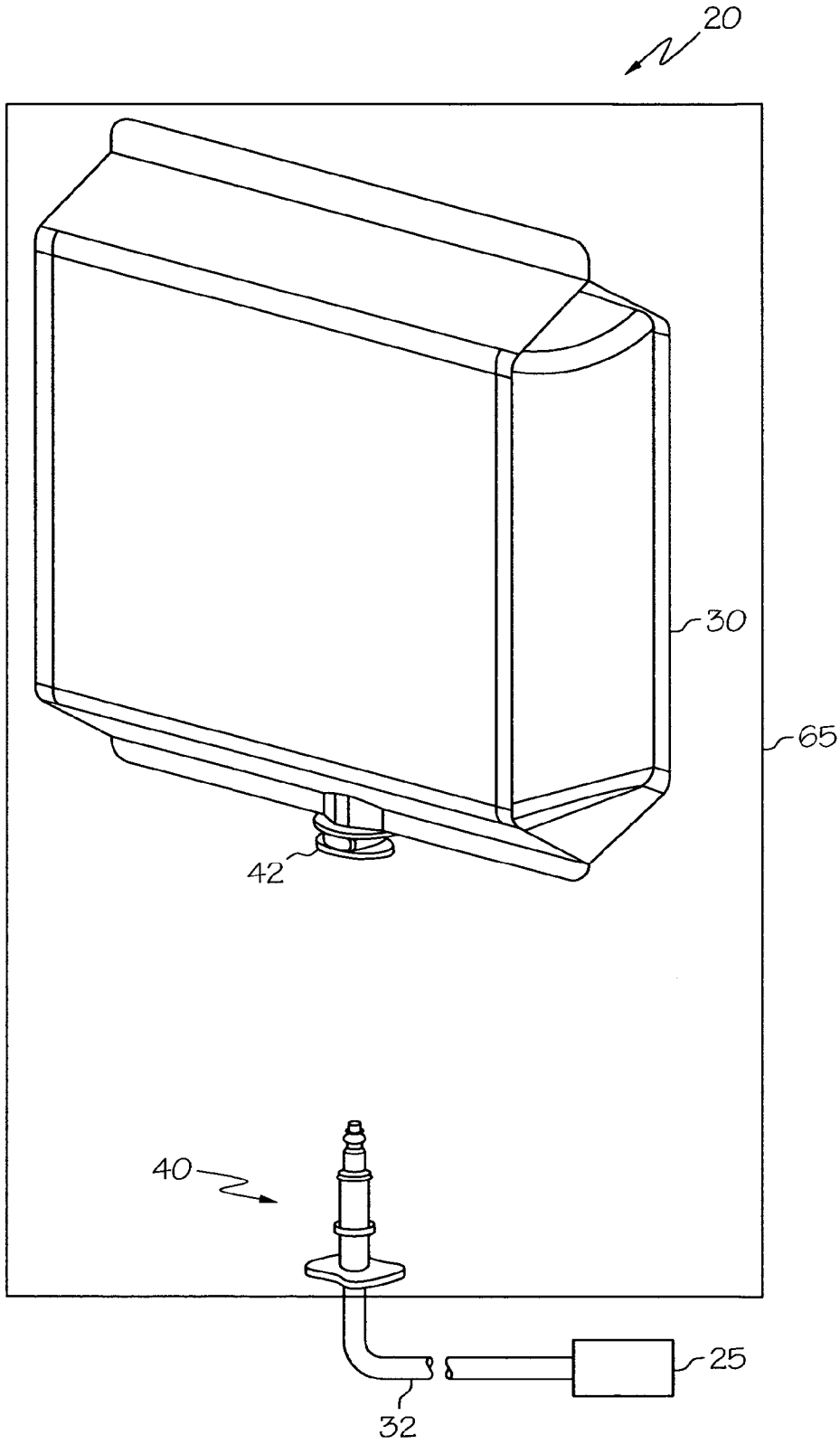
FIG. 1 is a schematic illustration of an exemplary fabric article treating device according to a first embodiment of the present invention.

The embodiments set forth in the drawings are illustrative in nature and not intended to be limiting of the invention defined by the claims. Moreover, individual features of the drawings and the invention will be more fully apparent and understood in view of the detailed description.

DETAILED DESCRIPTION OF THE INVENTION

Reference will now be made in detail to various embodiments of the invention, examples of which are illustrated in the accompanying drawings, wherein like numerals indicate similar elements throughout the views.

DEFINITIONS

All percentages, ratios and proportions herein are on a weight basis unless otherwise indicated. Except as otherwise noted, all amounts including quantities, percentages, portions, and proportions, are understood to be modified by the word "about", and amounts are not intended to indicate significant digits. Except as otherwise noted, the articles "a", "an", and "the" mean "one or more".

As used herein, "comprising" means that other steps and other ingredients which do not affect the end result can be added. This term encompasses the terms "consisting of" and "consisting essentially of". The compositions and methods/processes of the present invention can comprise, consist of, and consist essentially of the essential elements and limitations of the invention described herein, as well as any of the additional or optional ingredients, components, steps, or limitations described herein.

The phrase "fabric article treating system" as used herein means a fabric article treating device which may be discreet in relation to the fabric article drying appliance and/or it may be integrated into the fabric article drying appliance. Furthermore, the fabric article treating device may be integrated into a readily replaceable portion of the fabric article drying appliance, a non-limiting example of which includes a closure structure of the drying appliance.

"Fabric article" or "fabric" as used herein means any article that is customarily cleaned in a conventional laundry process or in a dry cleaning process. The term encompasses articles of fabric including, but not limited to, clothing, linen, drapery, clothing accessories, leather, floor coverings, sheets, towels, rags, canvas, polymer structures, and the like. The term also encompasses other items made in whole or in part of fabric material, such as tote bags, furniture covers, tarpons, shoes, and the like.

As used herein, the term "benefit composition" refers to a composition used to deliver a benefit to a fabric article. Non-limiting examples of materials and mixtures thereof which can comprise the benefit composition include: water, softening agents, crisping agents, perfume, water/stain repellants, refreshing agents, antistatic agents, antimicrobic agents, durable press agents, wrinkle resistant agents, odor resistance agents, abrasion resistance agents, solvents, and combinations thereof. The benefit composition may comprise a liquid, a powder, a suspension, or gaseous product, and/or a combination of such. In one embodiment, the benefit composition includes a preservative. Various preservatives which help maintain one or more properties of the benefit composition are generally known in the art and are suitable for use herein. One exemplary preservative is Dantoguard Plus™ (Dimethylol-5,5-Dimethylhydantoin) commercially available from Lonza, (Fairfield, N.J., USA).

FIG. 1 illustrates an exemplary fabric article treating device 20 according to one embodiment of the present invention. The fabric article treating device 20 comprises a dispenser 25, a removable reservoir 30 and a housing 65. The housing 65 is adapted to receive the removable reservoir 30. The dispenser 25 and the removable reservoir 30 are adapted for fluid communication with one another, for example via fluid line 32. The housing 65 comprises one of corresponding male and female fitments 40, and wherein the reservoir 30, shown as a sealed pouch or carton, comprises the other of the corresponding male and female fitments 42, wherein the female fitment is configured to receive the male fitment to establish the fluid communication between the dispenser 25 and the removable reservoir 30. One of the fitments is adapted to pivot to aid in engaging the corresponding fitment. In the embodiment of FIG. 1, the fitment 42 on the reservoir 30 is the female fitment, while the corresponding male fitment 40 is adapted for fluid connection with the dispenser 25, for example via a fluid handling system as described hereafter. Various corresponding male and female fitments which establish fluid communication while minimizing any leakage of benefit composition are generally known in the art and are suitable for use herein. One exemplary fitment that may be utilized is available from IPN USA Corp. of Peachtree City, Ga., available as Clean-Clic® pouch fitments, model SBS-4. As one skilled in the art will appreciate, any fitment combination can be utilized in the present invention provided the fitments are configured to minimize leakage of the benefit composition from the reservoir 30.

Figure 6A:
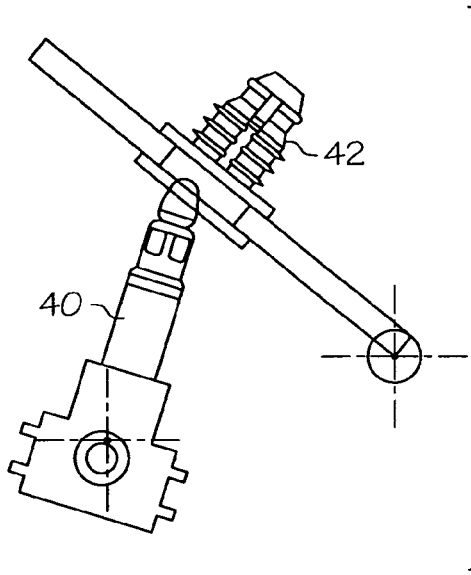
FIG. 6 is a schematic illustration of a portion of an exemplary fabric article treating device according to a sixth embodiment of the present invention.
Figure 6B:
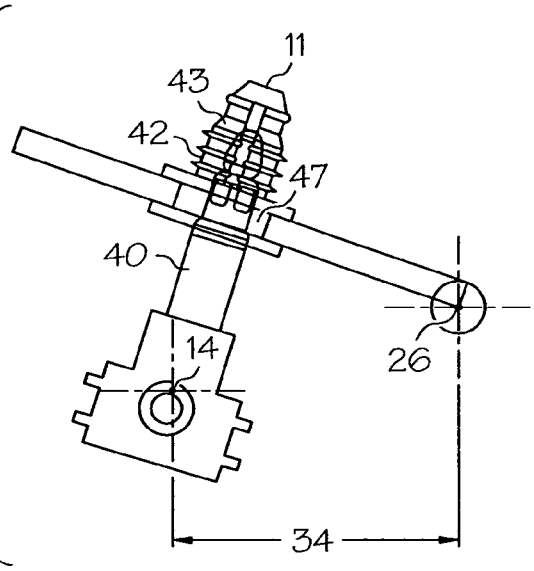
Figure 6C:
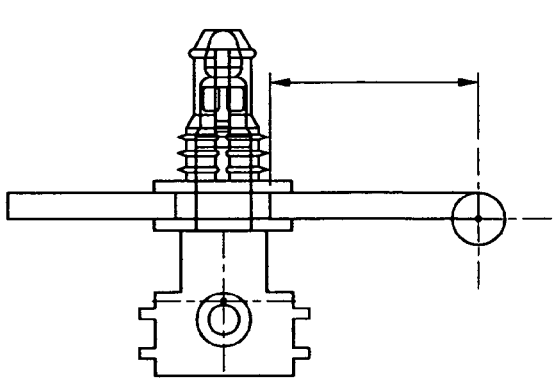

In one exemplary embodiment, the male fitment 40 is adapted to pivot to aid in engaging the female fitment 42. In another exemplary embodiment, the male fitment is adapted to pivot from an installation position to a use position. The installation position comprises an initial position of the male fitment before engagement with the female fitment. The use position comprises the position of the male fitment when substantially engaged with the female fitment. FIG. 6A depicts an exemplary embodiment of the present invention wherein the male fitment 40 is in the installation position. FIG. 6C depicts an exemplary embodiment of the present invention wherein the male fitment 40 is in the use position. In another exemplary embodiment, the pivot of the male fitment 40 has an angle of rotation ranging from about 5 degrees to about 45 degrees. In an alternative embodiment, the angle of rotation ranges from about 15 degrees to about 30 degrees.

Figure 10:
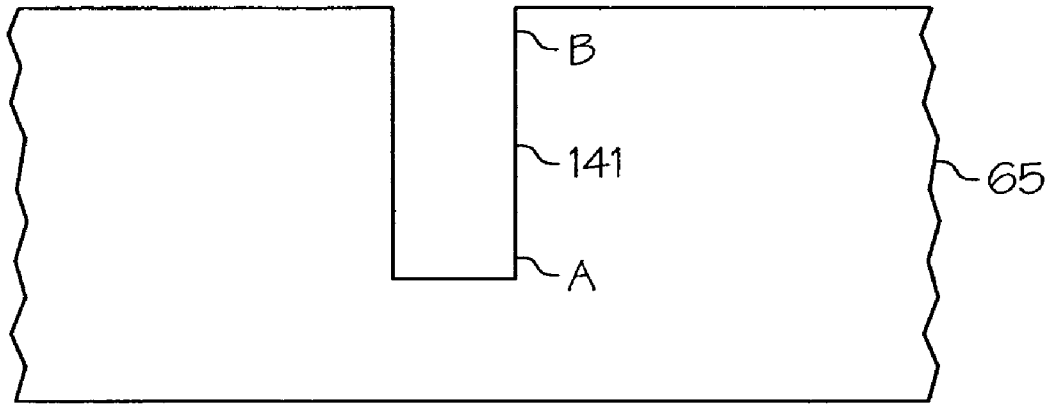
FIG. 10 is a schematic illustration of a portion of an exemplary fabric article treating system according to a tenth embodiment of the present invention.

One exemplary embodiment of the present invention is illustrated in FIG. 10, in which the housing 65 is provided with a slot 141 adapted to slidingly receive the female fitment 42 when the female fitment 42 is receiving the male fitment 40. The slot 141 is adapted to allow the female fitment 42 to slide from a first position (A) to a second position (B).

Figure 7A:
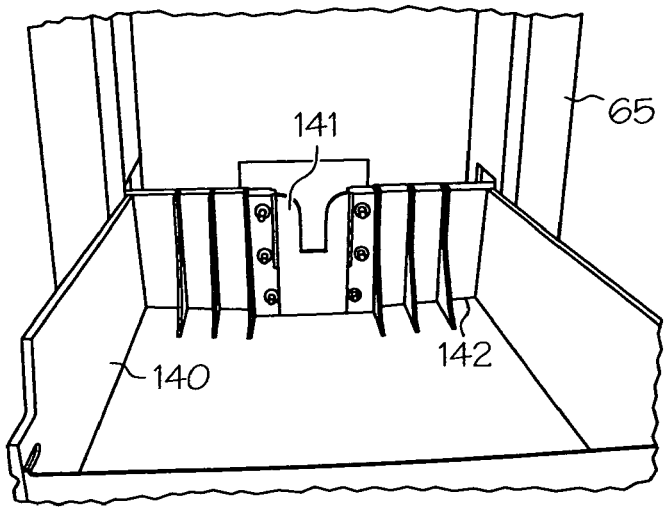
FIG. 7 is a schematic illustration of a portion of an exemplary fabric article treating system according to a seventh embodiment of the present invention.
Figure 7B:
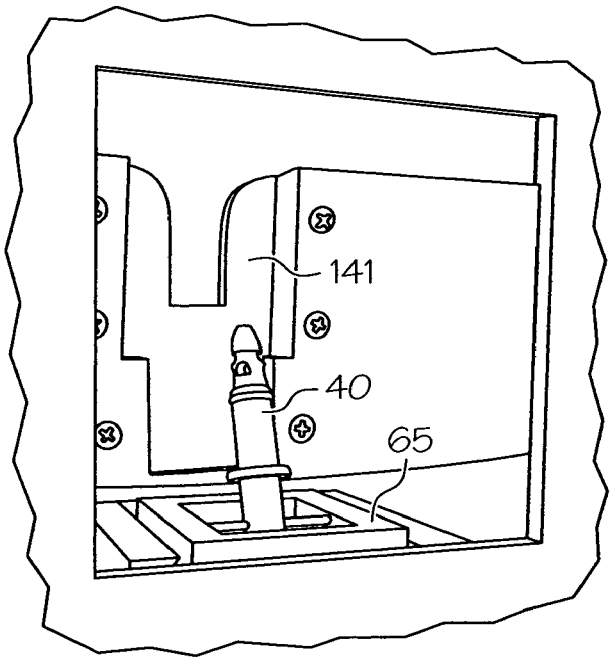
Figure 7C:
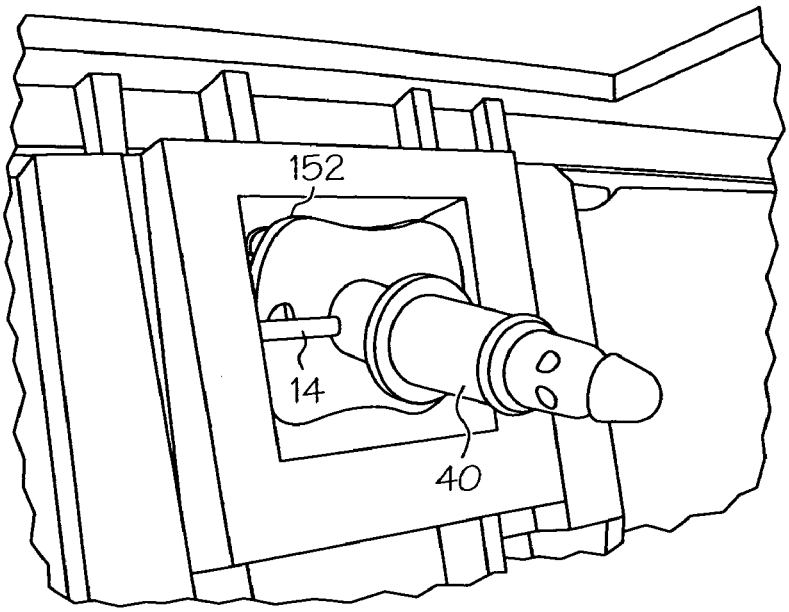
Figure 7D:
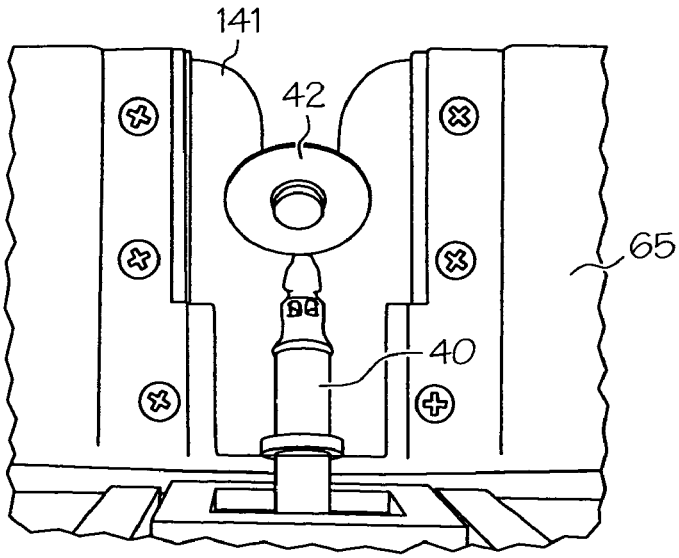
Figure 7E:
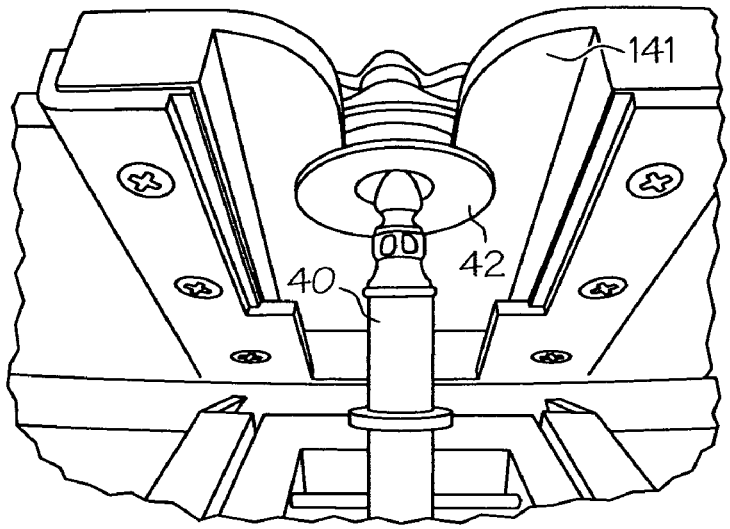
Figure 7F:
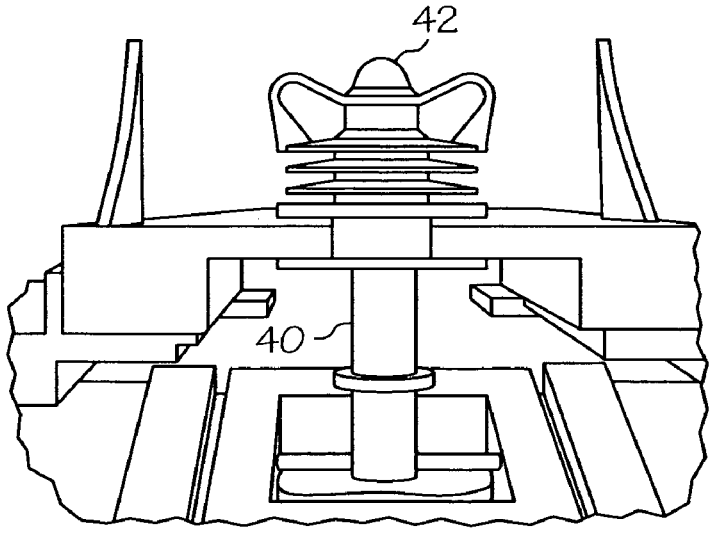

Another exemplary embodiment is illustrated in FIGS. 7A-7F. The fabric article treating device housing 65 further comprises a door 140. The door 140 is adapted to pivot from an open position (as illustrated in FIG. 7A) to a close position (not shown) along an axis 142. The door 140 is configured such that in the closed position the male fitment is substantially engaged with the female fitment. In a further exemplary embodiment illustrated in FIGS. 7A and 7B, the slot 141 is provided on the door 140. The slot 141 is adapted to slidingly receive the female fitment 42 when the female fitment 42 is receiving the male fitment 40. The slot 141 is adapted to allow the female fitment 42 to slide from a first position (A) to a second position (B). In this embodiment, the user can easily load a removable reservoir containing the female fitment into the door and place the female fitment 42 in the slot 141 of the door 140. FIGS. 7B and 7C illustrate an exemplary embodiment of the male fitment 40 attached to the housing 65. The male fitment 40 is adapted to pivot along an axis 14. In one exemplary embodiment as depicted in FIG. 7C, the male fitment 40 is maintained at a desired angle by a flexible spring mechanism 152 that is adapted to allow or bias the male fitment 40 to become upright as the female fitment 42 and the male fitment 40 interact. FIG. 7D illustrates an exemplary embodiment of the female fitment 42 in the slot 141 of the door 140. FIGS. 7E and 7F illustrate exemplary embodiments of the male fitment 40 interacting with the female fitment 42. In FIG. 7E, the female fitment 42 is located in the slot 141 in the door 140. As the door 140 is closed towards the housing 65, the tip 11 of the male fitment 40 comes into contact with the female fitment 42. The female fitment 42 may slide upwards in the slot 141 to provide a better engaging angle with the male fitment 40. FIG. 7F is an exemplary illustration of the male fitment 40 and the female fitment 42 engaged to provide fluid communication between the removable reservoir 30 and the dispenser 25.

As one skilled in the art will appreciate, configuration of the male fitment and female fitment may vary due to a number of factors, including, but not limited to, size of the fitments, angle of rotation of male fitment, length of slot adapted to receive female fitment, etc.

In one embodiment, the fluid connection between the dispenser 25 and the removable reservoir 30 comprises tubing configured to allow the benefit composition to be transported from the removable reservoir 30 to the dispenser 25. One exemplary tubing comprises a polymeric tubing with one or more channels or conduits. In one embodiment, the tubing is configured to allow the closure structure on the fabric article drying appliance to maintain a closed position while still permitting dispensing of the benefit composition.

The removable reservoir 30 is configured to contain a benefit composition. In one embodiment, the removable reservoir is configured with minimum head-space or void volume designed to maintain an anaerobic environment within the reservoir during dispensing of the benefit composition. In another exemplary embodiment, the reservoir 30 comprises a sealed pouch.

The removable reservoir 30 may be constructed of any material known in the art which is compatible with the benefit composition in the reservoir. Non-limiting examples of such materials include polymeric materials including but not limited to polyurethane, polypropylene, polyethylene, polycarbonate, polyethylene terephthalate (PET), polyvinyl chloride (PVC), polystyrene, nylon, polyester, and the like. Other exemplary materials of construction include aluminum foil. In one embodiment, the removable reservoir 30 comprises multiple layers of one or more materials. In another embodiment, the removable reservoir 30 comprises a single or multiple layer barrier film.

Figure 2:
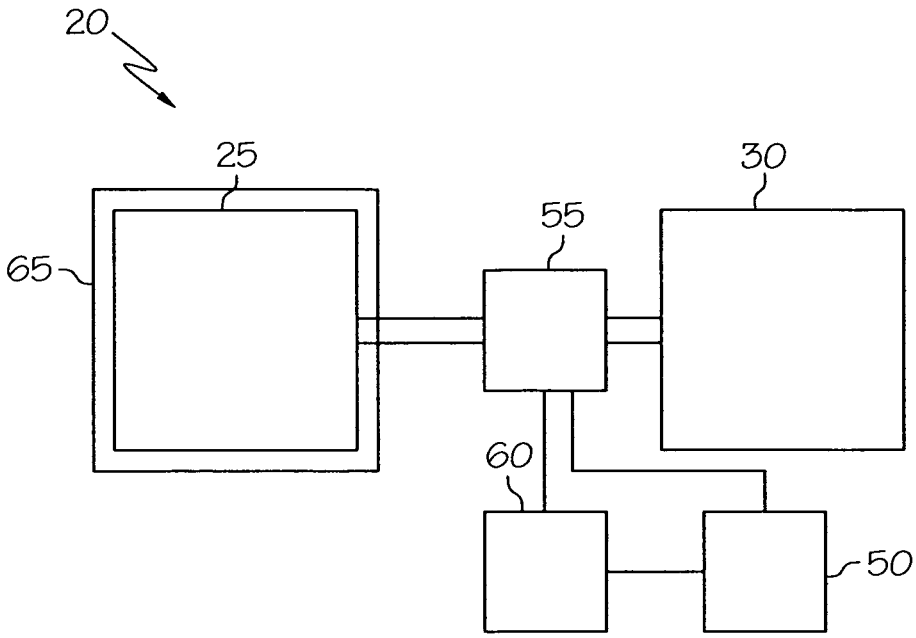
FIG. 2 is a schematic illustration of an exemplary fabric article treating device according to a second embodiment of the present invention.

The dispenser 25 may comprise at least one nozzle for the purpose of distributing the benefit composition into the fabric article drying appliance. Misting/atomizing of the benefit composition can be achieved using any suitable spraying device such as a hydraulic nozzle, sonic nebulizer, pressure swirl atomizers, high pressure fog nozzle or the like to deliver target particle size. Non-limiting examples of suitable nozzles include nozzles commercially available from Spray Systems, Inc. of Pomona, Calif. under the Model Nos. 850, 1050, 1250, 1450 and 1650. Another suitable example of a nozzle is a pressure swirl atomizing nozzle made by Seaquist Perfect Dispensing of Cary, Ill. under Model No. DU-3813. In one exemplary embodiment, as illustrated in FIG. 2, the fabric article treating device 20 further comprises a fluid handling system 55, a power source 50 and a controller 60. In one exemplary embodiment, the fluid handling system 55 is configured to transport the benefit composition from the removable reservoir 30 to the dispenser 25. The dispenser 25 is configured to deliver the benefit composition to one or more fabric articles in the fabric article drying appliance. The power source 50 is configured to provide electrical power as needed by the fluid article treating device, such as the controller 60, the fluid handling system 55, sensors, and any electrical needs of a user interface. The controller 60 is configured to regulate the dispensing of the benefit composition. For example, the controller 60 may determine the optimum condition to dispense the benefit composition, the quantity of benefit composition to be dispensed and the rate at which to dispense the benefit composition. In one embodiment, the fabric article treating device further comprises a communication link adapted to provide communication between the controller of the fabric article treating device and the fabric article drying appliance. For example, the controller may send and/or receive signals to/from the fabric article drying appliance to determine the optimum benefit composition dispensing conditions such as, time, length, etc.

Figure 3:
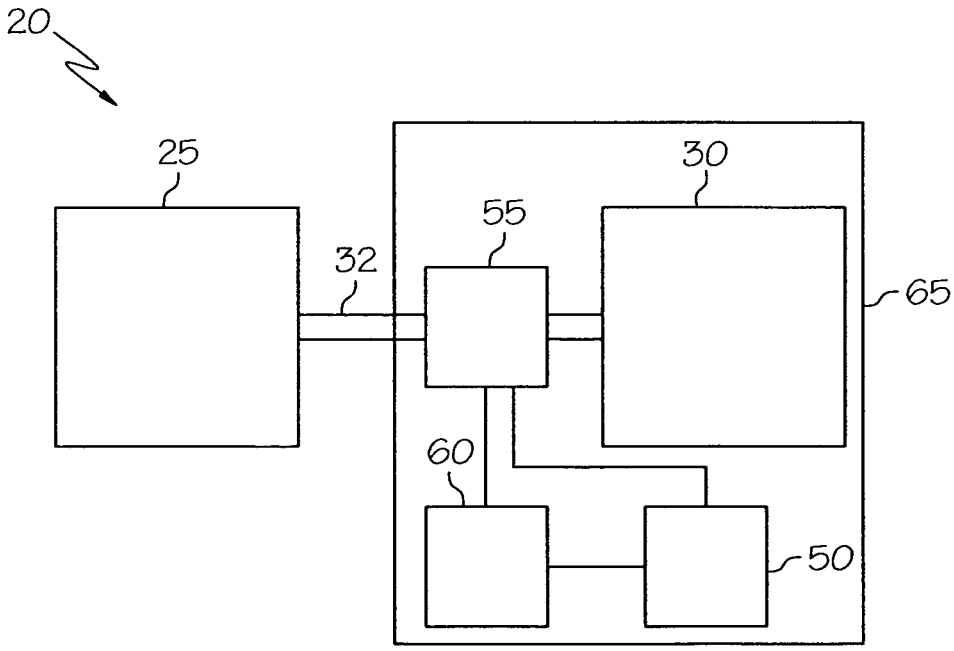
FIG. 3 is a schematic illustration of an exemplary fabric article treating device according to a third embodiment of the present invention.

Another exemplary embodiment of the present invention is illustrated in FIG. 3. In this exemplary embodiment, the housing 65 is adapted to receive various components in addition to the removable reservoir 30. Optionally, the housing may substantially enclose and protect the components in their assembled form. For example, as shown in FIG. 3, the housing 65 may receive the power source 50, the fluid handling system 55, the controller 60 and the removable reservoir 30. In another embodiment, the housing 65 may comprise a tubing storage area adapted to contain a quantity of fluid line 32 to allow the user to customize the installation of the fabric article treating device for the user's particular fabric article drying appliance. The housing 65 may be constructed with any materials known to one skilled in the art. Exemplary materials include but are not limited to polymers, plastics, ceramics, metals, fabric, wood, and the like.

Figure 4:
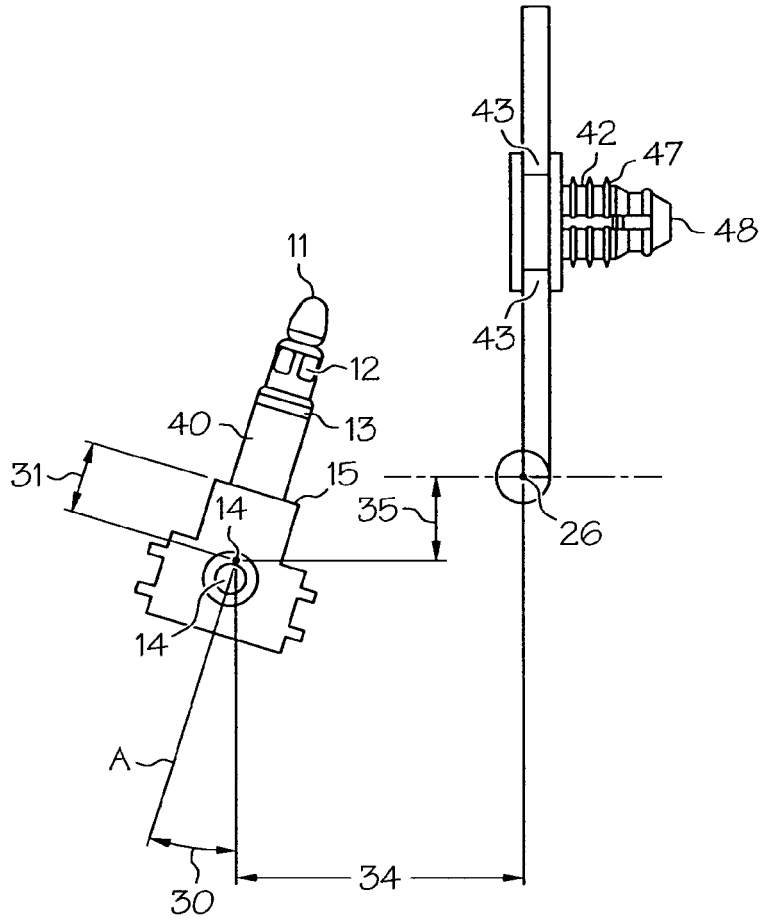
FIG. 4 is a schematic illustration of a portion of an exemplary fabric article treating device according to a fourth embodiment of the present invention.
Figure 5:
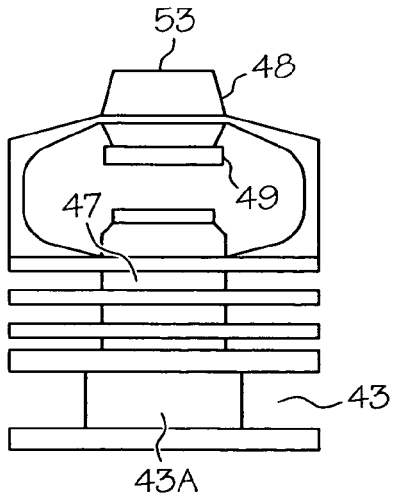
FIG. 5 is a schematic illustration of a portion of an exemplary fabric article treating device according to a fifth embodiment of the present invention.

In one exemplary embodiment as illustrated in FIG. 4, the male fitment 40 has a tip 11, orifices 12 for fluid flow, an o-ring 13 for sealing the fitment in engagement with the fitment 42, an axis of rotation 14 and a seating lip 15. The female fitment 42 comprises slots 43 for gripping and positioning, a seal chamber 47 and a removable plug seal 48. The plug seal 48 is seated in the seal chamber 47 in the closed position in FIG. 4. In one exemplary embodiment, the distance 34 between the axis of rotation 14 and the seating lip 15 is between about 30 and about 40 mm, and in an alternative embodiment, the distance is about 34 mm. FIG. 5 shows the female fitment 42 in the open position with plug seal 48 removed from the seal chamber. In one embodiment, the plug seal 48 has a lower edge 49. In another exemplary embodiment, the tip 11 of the male member 40 is adapted to click fit inside the plug seal 48 at the top portion 53 of the plug seal.

In one exemplary embodiment of the present invention as illustrated in FIG. 4, the male fitment 40 and the female fitment 42 are configured such that during the engaging process, the o-ring 13 of the male fitment 40 is positioned inside the bottom of the seal chamber 47 of the female fitment 42.

In another exemplary embodiment, the tip 11 of the male fitment 40 enters the plug seal 48 of the female fitment 42 without touching the lower end of the plug seal 48 and then connects securely with a click fit at the top of the plug seal 48. The plug seal 48 is configured to only open when the tip 11 of the male fitment is securely attached to the female plug seal 48. In this embodiment, the female fitment is configured such that when the male fitment is disengaged from the female fitment, the plug seal 48 is biased to re-close and form a seal in the seal chamber 47.

Figure 8:
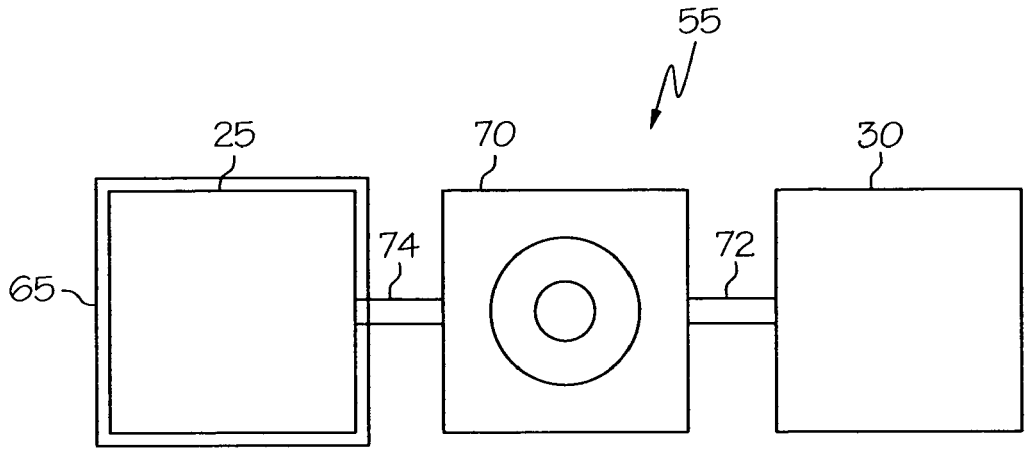
FIG. 8 is a schematic illustration of an exemplary fabric article treating system according to an eighth embodiment of the present invention.

In one exemplary embodiment as illustrated in FIG. 8, the fluid handling system 55 comprises a pump 70. The pump 70 is in communication with the removable reservoir 30 and the dispenser 25 via fluid lines 72 and 74, respectively. The pump 70 is configured to transport benefit composition from the removable reservoir 30 to the dispenser 25 for dispensing of the benefit composition. In one embodiment, the pump 70 comprises a piezo-electric pump. In another embodiment, the pump 70 may comprise a diaphragm pump. As one skilled in the art will appreciate any pump known to one skilled in the art may be utilized to transport the benefit composition from the removable reservoir 30 to the dispenser 25. Other exemplary pumps include piston pumps, gear pumps, peristaltic pumps, and bellows-type pumps.

As noted above, one type of pump 70 that can be used in the present invention is a piezo-electric pump. While a piezo-electric pump has certain membranes or laminations which may vibrate in a reciprocating-type fashion, the piezo-electric pumps generally do not have major moving parts, such as rotating shaft and bearings used with a rotator member to displace a fluid or gaseous fluid, that experience wear over time. One commercially available suitable piezo-electric pump usable in the present invention is manufactured by PAR Technologies, LLC, located in Hampton, Va., and marketed as the "LPD-Series" laminated piezo-electric fluid pumps. Pumps which draw a relevantly low current are particularly suitable in certain embodiments.

In another embodiment, the removable reservoir 30 may be positioned in such a way to provide gravitation flow of the benefit composition to the dispenser 25. For example, the removable reservoir 30 may be mounted above the fabric article drying appliance to create static head on the benefit composition to allow dispensing of the benefit composition without the utilization of a pump.

Figure 9:
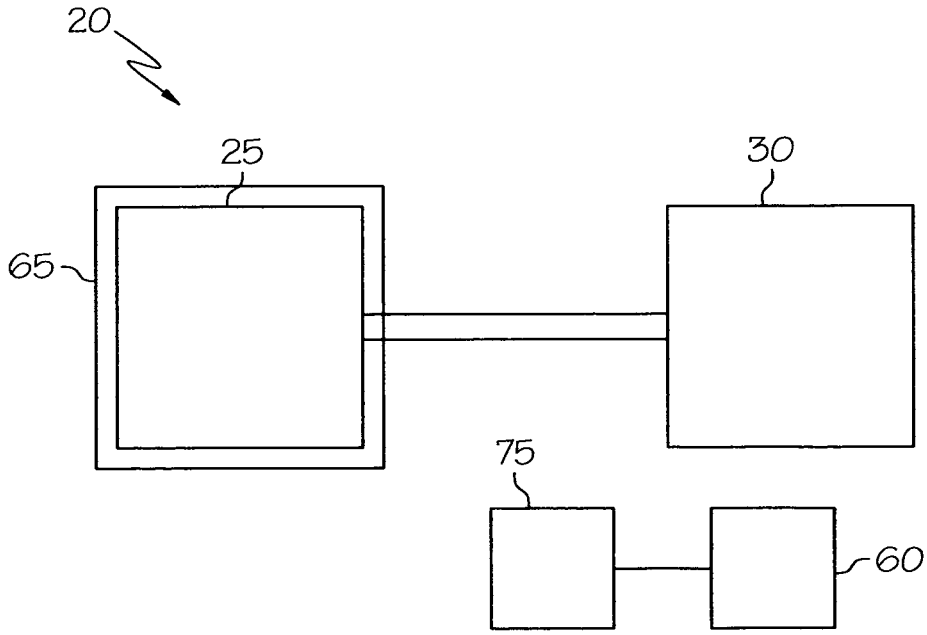
FIG. 9 is a schematic illustration of an exemplary fabric article treating system according to a ninth embodiment of the present invention.

Another exemplary embodiment of the present invention is illustrated in FIG. 9. In this embodiment, as in previously discussed embodiments, the fabric article treating device 20 comprises a dispenser 25 adapted for location inside of a fabric article drying appliance and an removable reservoir 30 adapted for location outside of the fabric article drying appliance. The dispenser 25 and the removable reservoir 30 are adapted for fluid communication with one another. The removable reservoir 30 contains a benefit composition. The device further comprises a controller 60 in electrical communication with a sensor 75. In one exemplary embodiment, the sensor comprises a temperature sensor. In another exemplary embodiment, the sensor 75 comprises a light sensor. In yet another exemplary embodiment, the sensor 75 comprises a motion sensor. The controller 60 is adapted to send and/or receive signals from the sensor 75 and to determine the dispensing conditions for dispensing the benefit composition.

Optionally, filters and/or filtering techniques can be used to filter the benefit composition, if desired, for example at a point between the reservoir 30 and the outlet of the dispenser 25. Non-limiting examples of this include: utilizing a filter in the dispenser 25 prior to dispensing of the benefit compositions. Alternatively, the benefit composition may be filtered prior to dispensing into the reservoir; or a combination of filtering techniques may be employed.

The dispenser 25 and the removable reservoir 30 are adapted for fluid communication with one another. In one embodiment, the dispenser 25 and the removable reservoir 30 may be in electrical connection to one another. Non-limiting examples of connecting the dispenser 25 and the removable reservoir 30 may include utilizing a flat cable (also referred to as a ribbon cable), a wire, a wire or group of wires enclosed in a stealth of woven or nonwoven material, a conduit (a non-limiting example of which is a conduit for the benefit composition), or combination thereof. The woven or nonwoven sheet may be used as a method of attaching the dispenser 25 and the removable reservoir 30. The dispenser 25 and the removable reservoir 30 may be used to provide a means of gravitational counterbalancing so as to reduce unnecessary tension on the wires and/or the connections.

The power source 50 may comprise chemical batteries, or any electrical power source, including standard household line voltage, or even solar power. Batteries may be utilized, and are particularly suitable when the fabric article treating device 20 is in the form of an add-on device for an existing fabric article drying appliance 35. However, any appropriate power adapter can be provided to convert an AC power source to the appropriate DC voltages used in any electrical components of the fabric article treating device 20, such as in the fluid handling system 55, the controller 60, and any sensors 75. The power source 50 may also comprise any mechanical power source used to store potential energy. Non-limiting examples include; springs, weights, compressed gases, etc.

As noted, the fabric article treating device 20 can include optional sensors 75. Non-limiting examples of optional sensors include a door (or lid sensor), a motion sensor, a humidity sensor, and/or a temperature sensor. One non-limiting example of a door/lid sensor is an optoelectronic device, such as an optocoupler or an optical input sensor, e.g., a phototransistor or photodiode. When the door/lid of the drying appliance is open, the door sensor will change state, and will output a different voltage or current level along an electrical conductor that leads from the door sensor back to the controller. This can be used as a safety device to immediately interrupt the dispensing of the benefit composition from the dispenser 25. The optional door sensor could be utilized even when a control system is integrated into the overall conventional control system of the drying appliance. For example, a drying appliance typically has its own door sensor which shuts off the rotating drum of the dryer when the door becomes open. In this instant, the optional door sensor can act as a backup or second door sensor to the dryer's internal original sensor that shuts off the rotating drum. One example which could be used as a door/lid sensor is an NPN Phototransistor, Part No. PNA1801L, manufactured by Panasonic, of Osaka, Japan. In another embodiment, a communication link could be established between the drying appliance and the controller, wherein the drying appliance would send the controller a signal relating to the operational state of the drying appliance (e.g., door open/closed, drying cycle, temperature, etc.).

Another type of optional sensor 75 that can be utilized by the fabric article treating device 20 of the present invention is a motion sensor. For fabric article drying appliances 35 which utilize a moving interior, such as a rotating drum, the motion sensor can detect if a fabric article drying appliance is in use. One example of a motion sensor is a vibration and movement sensing switch manufactured by ASSEM Tech Europe Ltd., of Clifton, N.J., available as Model No. CW1600-3. Another type of optional motion sensor that may be used in the present invention uses a light source to direct (infrared) light at a surface, and the relevant motion of that surface can be detected by the intensity and/or frequency of the returning light. Such sensors can measure the actual speed of rotation, if that information is desired.

Another optional sensor 75 that can be used in a fabric article treating device 20 of the present invention is a humidity sensor. The optional humidity sensor, together with the controller, may be used to control the amount of composition being dispensed by the dispenser 25, and also may be utilized to determine the proper environmental conditions during an operational cycle in which the dispensing event should take place. Additionally, this humidity sensor may be used to maintain a specific humidity by controlling the dispensing the benefit composition such that optimal de-wrinkling and/or other benefits are achieved. Many different types of humidity sensors could be used in conjunction with the present invention, including variable conductivity sensors. One such sensor is manufactured by Honeywell. of Freeport, Ill. under the Model No. HIH-3610-001, although any of the HIH-3610 series may be used.

A further optional sensor 75 that can be useful in the fabric article treating device 20 of the present invention is a temperature sensor, such as one that outputs an analog or digital signal along the electrical conductor that leads back to the controller.

As noted above, the fabric article treating device 20 may comprise a controller 60. In one embodiment, the controller may be a microcontroller. A suitable microcontroller is manufactured by MicroChip, of Chandler, Ariz. under the Part No. PIC16LS876-04/P. However, other microcontrollers made by different manufacturers could also easily be used. In one exemplary embodiment, the microcontroller includes on-board random access memory (RAM), on-board read only memory (ROM), which comprises electrically programmable non-volatile memory elements, as well as on-board input and output lines for analog and digital signals. The controller may also be used with a crystal clock oscillator, although a RC circuit could be used instead as a clock circuit, if desired. The clock circuit provides the timing of the clock as necessary to operate the controller. In one embodiment, the controller comprises a port that can be interfaced to an optional programmable interface using a communication link, such as RS-232 communication link. The port allows a user to alter the program information of the controller, such as dispensing options, etc.

One skilled in the art will appreciate that the controller can be any type of microprocessor or microcontroller circuit commercially available, either with or without on-board RAM, ROM, or digital and analog input/output (I/O). Moreover, a sequential processor may be used to control the fabric article treating device 20, or alternatively a parallel processor architecture or a logic state machine architecture could be used. Furthermore, the controller 60 may be integrated into an Application Specific Integrated Circuit (ASIC) containing many other logic elements that could be used for various functions, as desired, such functions being optional depending upon the model of the fabric article treating device 20 that will be sold to a consumer. To change model features, the manufacturer need only program the ASIC or the on-board RAM of the controller according to the special parameters of that particular model, while using the same hardware for each of the units.

It will also be understood that discrete digital logic could be used instead of any type of microprocessor microcontroller unit, or analog control circuitry could be used along with voltage comparators and analog timers, to control the timing events and to make decisions based on input levels of the various sensors that are provided with the fabric article treating device 20.

It will be understood that the present invention can be readily used in other types of fabric article drying appliances, and is not limited solely to clothes "dryers". In the context of this patent document, the terms "dryer" or "drying apparatus" or "fabric article drying appliance" include apparatuses that may or may not perform a true drying function, but may involve treating fabric without attempting to literally dry the fabric itself. As noted above, the terms "dryer" or "drying apparatus" or "fabric article drying appliance" may include a "dry cleaning" process or apparatus, which may or may not literally involve a step of drying. The term "fabric article drying appliance" as used herein, also refers to any fabric treating apparatus that utilizes moving air directed upon one or more fabric articles, a non-limiting example of which includes a clothes dryer, and modifications thereof. Such apparatuses include both domestic and commercial drying units used in dwellings, laundromats, hotels, and/or industrial settings. In addition, it should be noted that some drying appliances include a drying chamber (or "drum") that does not literally move or rotate while the drying appliance is operating in the drying cycle. Some such dryers use moving air that passes through the drying chamber, and the chamber does not move while the drying cycle occurs. Such an example dryer has a door or other type of access cover that allows a person to insert the clothing to be dried into the chamber. In many cases, the person hangs the clothes on some type of upper rod within the drying chamber. Once that has been done, the door (or access cover) is closed, and the dryer can begin its drying function. Dispensing of a benefit composition can take place within such a unit, however, care should be taken to ensure that the benefit composition becomes well dispersed within the drying chamber, so that certain fabric items do not receive a very large concentration of the benefit composition while other fabric items receive very little of the benefit composition.

Exemplary fabric article treating devices and systems include those described in co-pending U.S. application Ser. No. 10/697,735 filed on Oct. 29, 2003; U.S. application Ser. No. 10/697,685 filed on Oct. 29, 2003; U.S. application Ser. No. 10/697,734 filed on Oct. 29, 2003; U.S. application Ser. No. 10/697,736 filed on Oct. 29, 2003; U.S. application Ser. No. 10/762,152 filed on Jan. 21, 2004; U.S. application Ser. No. 10/926,925 filed on Aug. 26, 2004; and U.S. application Ser. No. 10/927,211 filed on Aug. 26, 2004.

All documents cited in the detailed description of the invention are, in relevant part, incorporated herein by reference. A citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fabric article treating device, comprising:

a dispenser and a removable reservoir, wherein the dispenser and removable reservoir are adapted for fluid communication with one another, and wherein the removable reservoir is configured to contain a benefit composition;

a housing adapted to receive the removable reservoir;

wherein the housing comprises one of corresponding male and female fitments and wherein the removable reservoir comprises the other of the corresponding male and female fitments, wherein the female fitment is configured to receive the male fitment to establish fluid communication between the dispenser and the removable reservoir;

wherein one of the fitments comprises a pivoting fitment adapted to pivot about its own axis to aid in engaging the corresponding fitment; and wherein the housing further comprises a door, wherein the door is adapted to pivot from an open position to a closed position, such that in the closed position the male fitment is engaged with the female fitment.

2. The fabric article treating device of claim 1, wherein the housing is provided with a slot adapted to slidingly receive the corresponding fitment when the female fitment is receiving the male fitment.

3. The fabric article treating device of claim 2, wherein the slot is adapted to allow the corresponding fitment to slide from a first position to a second position.

4. The fabric article treating device of claim 3, wherein the first position is located at a distance of from about 0.1 mm to about 10.0 mm from the second position.

5. The fabric article treating device of claim 3, wherein the first position is located at a distance of from about 4.0 mm to about 5.0 mm from the second position.

6. The fabric article treating device of claim 2, wherein the slot is provided on the door.

7. The fabric article treating device of claim 1, wherein the pivoting fitment is adapted to pivot between an installation position and a use position.

8. The fabric article treating device of claim 7, wherein the pivoting fitment has an angle of rotation ranging from about 5 degrees to about 45 degrees.

9. The fabric article treating device of claim 7, wherein the pivoting fitment has an angle of rotation ranging from about 15 degrees to about 30 degrees.

10. The fabric article treating device of claim 1, wherein the removable reservoir comprises the female fitment and the housing comprises the male fitment.

11. The fabric article treating device of claim 1, wherein the male fitment comprises:

a tip, wherein the tip is adapted to fit within the female fitment when connected;

one or more orifices adapted for fluid flow; and an o-ring adapted for providing a fluid seal with the corresponding female fitment;

and wherein the female fitment comprises a seal chamber and a removable plug seal, wherein the plug seal is seated in the seal chamber in a closed position.

12. The fabric article treating device of claim 1, further comprising:

a power source;

a fluid handling system; and a controller.

13. The fabric article treating device of claim 12, wherein the fluid handling system is configured to transport benefit composition from the removable reservoir to the dispenser, and wherein the dispenser is configured to deliver benefit composition to one or more fabric articles in a fabric article drying appliance.

14. The fabric article treating device of claim 13, wherein the fluid handling system includes a piezo-electric pump.

15. The fabric article treating device of claim 13, wherein the fluid handling system is further configured to filter benefit composition.

16. The fabric article treating device of claim 12, wherein the housing is adapted to receive the power source, the fluid handling system, the controller and the removable reservoir.

17. The fabric article treating device of claim 1, wherein the reservoir comprises a single or multi-layer barrier film.

18. The fabric article treating device of claim 1, wherein the reservoir comprises a sealed pouch.

19. The fabric article treating device of claim 1, further comprising a controller and at least one sensor in electrical communication with the controller.

20. The fabric article treating device of claim 19, wherein the at least one sensor comprises a temperature sensor.

21. The fabric article treating device of claim 19, wherein the at least one sensor comprises a light sensor.

22. The fabric article treating device of claim 19, wherein the at least one sensor comprises a motion sensor.

23. The fabric article treating device of claim 1, further comprising a communication link adapted for connection with a fabric article drying appliance.

24. The fabric article treating device of claim 1, wherein the reservoir contains a benefit composition including a preservative.

25. A fabric article treating device, comprising:

a dispenser and a removable reservoir, wherein the dispenser and removable reservoir are adapted for fluid communication with one another, and wherein the removable reservoir is configured to contain a benefit composition;

a housing adapted to receive the removable reservoir;

wherein the housing comprises a male fitment and wherein the removable reservoir comprises a corresponding female fitment, wherein the female fitment is configured to receive the male fitment to establish fluid communication between the dispenser and the removable reservoir;

wherein the male fitment comprises a pivoting fitment adapted to pivot about its own axis between an installation position and a use position to aid in engaging the female fitment;

wherein the housing further comprises a door, wherein the door is adapted to pivot from an open position to a closed position, such that in the closed position the male fitment is engaged with the female fitment; and wherein the door is provided with a slot adapted to slidingly receive the female fitment when the female fitment is receiving the male fitment, wherein the slot is adapted to allow the female fitment to slide from a first position to a second position.

26. A fabric article treating system, comprising:

a fabric article drying appliance having a chamber and a closure structure, the closure structure having a closed position and at least one open position, the closure structure allowing access to the chamber;

a dispenser and a removable reservoir, wherein the dispenser and removable reservoir are adapted for fluid communication with one another, and wherein the removable reservoir is configured to contain a benefit composition, and wherein the fabric article drying appliance is adapted to receive the removable reservoir;

wherein the fabric article drying appliance comprises one of corresponding male and female fitments and wherein the removable reservoir comprises the other of the corresponding male and female fitments, wherein the female fitment is configured to receive the male fitment to establish fluid communication between the dispenser and the removable reservoir; and wherein one of the fitments comprises a pivoting fitment adapted to pivot about its own axis to aid in engaging the corresponding fitment.

* * * * *